US012667874B2

(12) United States Patent
Garot

(10) Patent No.: US 12,667,874 B2
(45) Date of Patent: Jun. 30, 2026

(54) ROLLING MILL WITH MOVABLE HOUSING AND SEALED DOOR

(71) Applicant: FIVES DMS, Lezennes (FR)

(72) Inventor: Pierre Garot, Bailleul (FR)

(73) Assignee: FIVES DMS, Lezennes (FR)

( * ) Notice: Subject to any disclaimer, the term of this patent is extended or adjusted under 35 U.S.C. 154(b) by 313 days.

(21) Appl. No.: 18/581,767

(22) Filed: Feb. 20, 2024

(65) Prior Publication Data

US 2024/0278300 A1 Aug. 22, 2024

(30) Foreign Application Priority Data

Feb. 22, 2023 (FR) ..... 2301625

(51) Int. Cl.
*B21B 13/02* (2006.01)
*B21B 1/22* (2006.01)

(52) U.S. Cl.
CPC ..... *B21B 13/02* (2013.01); *B21B 1/22* (2013.01)

(58) Field of Classification Search
CPC ..... B21B 1/22; B21B 13/02; B21B 13/147; B21B 31/08; B21B 31/10; B21B 31/18
USPC ..... 72/242.4
See application file for complete search history.

(56) References Cited

U.S. PATENT DOCUMENTS 2,776,586 A 1/1957 Sendzimir
3,076,360 A * 2/1963 Sendzimir ..... B21B 13/147 72/242.4
3,858,424 A 1/1975 Kajiwara et al.
4,270,377 A * 6/1981 Verbickas ..... B21B 13/145 72/247
5,193,377 A 3/1993 Sendzimir et al.
5,471,859 A 12/1995 Sendzimir et al.
6,098,439 A * 8/2000 Lecrivain ..... B21B 31/103 72/239
7,251,977 B2 * 8/2007 Mondiere ..... B21D 1/05 72/241.2

(Continued)

FOREIGN PATENT DOCUMENTS

DE 3221346 A1 12/1983
EP 4094855 A1 11/2022

(Continued)

OTHER PUBLICATIONS

JP 2008-221291A, Honjo et al. Sep. 2008.*

(Continued)

*Primary Examiner* — Edward T Tolan
(74) *Attorney, Agent, or Firm* — Maier & Maier, PLLC

(57) ABSTRACT

A 20-high rolling mill configured for rolling a metal strip, which includes a housing system comprising two parts capable of moving relative to one another, respectively forming an upper housing part, configured to transmit a clamping force to the four backup roller assemblies, of the upper group, and an upper housing part, configured to transmit a clamping force to the four backup roller assemblies of the lower group, and a door cooperating, in a closed position, with a peripheral frame of a fixed frame structure of the housing system surrounding the maintenance window, said door closing, in a sealed manner, said maintenance window. A system of axial stops for the second intermediate rolls accompanies the movements of the upper and lower housing parts.

11 Claims, 3 Drawing Sheets

(56) References Cited

U.S. PATENT DOCUMENTS 10,124,379 B2 * 11/2018 Lenz ..... B21B 31/18
11,173,528 B2 * 11/2021 Fujii ..... B21B 31/103

FOREIGN PATENT DOCUMENTS

GB 2023475 A 1/1980
WO 2015071608 A1 5/2015

OTHER PUBLICATIONS

KR 101511957B1, Yu et al. Apr. 2015.*
JP 61-232007A, Hayashi Oct. 1986.*
JP 62-38708A, Sugano Feb. 1987.*
Search Report and Written Opinion issued Aug. 3, 2023, in French Application No. 2301625, 10 pages.

* cited by examiner

[Fig. 1]
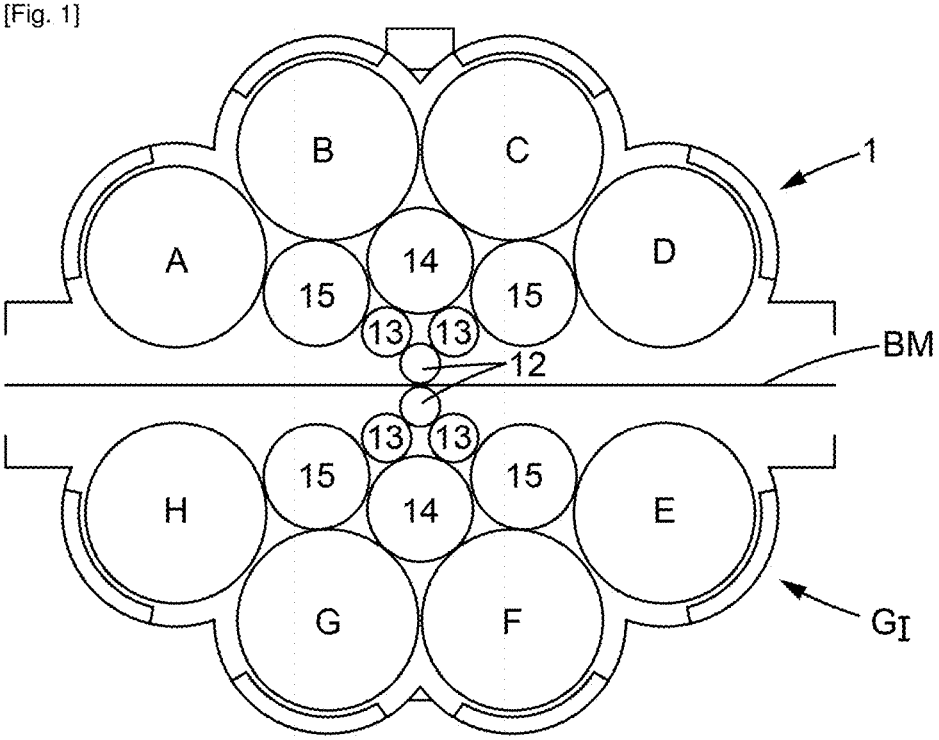
[Fig. 2]
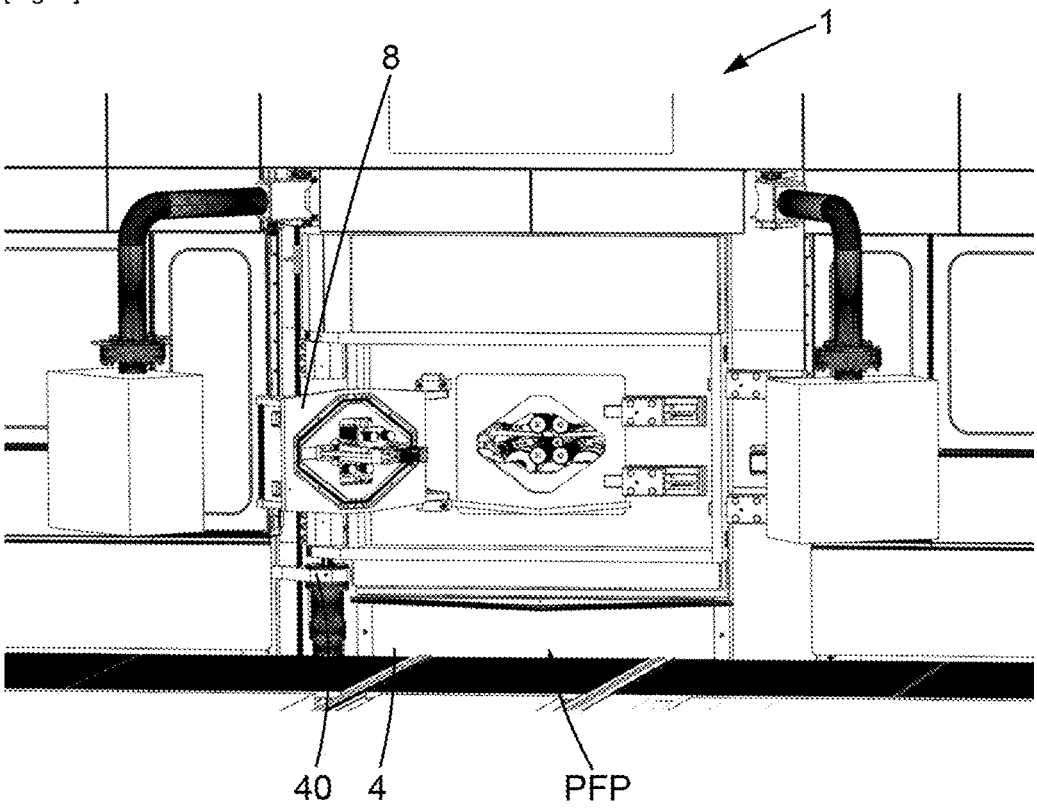

[Fig. 3]
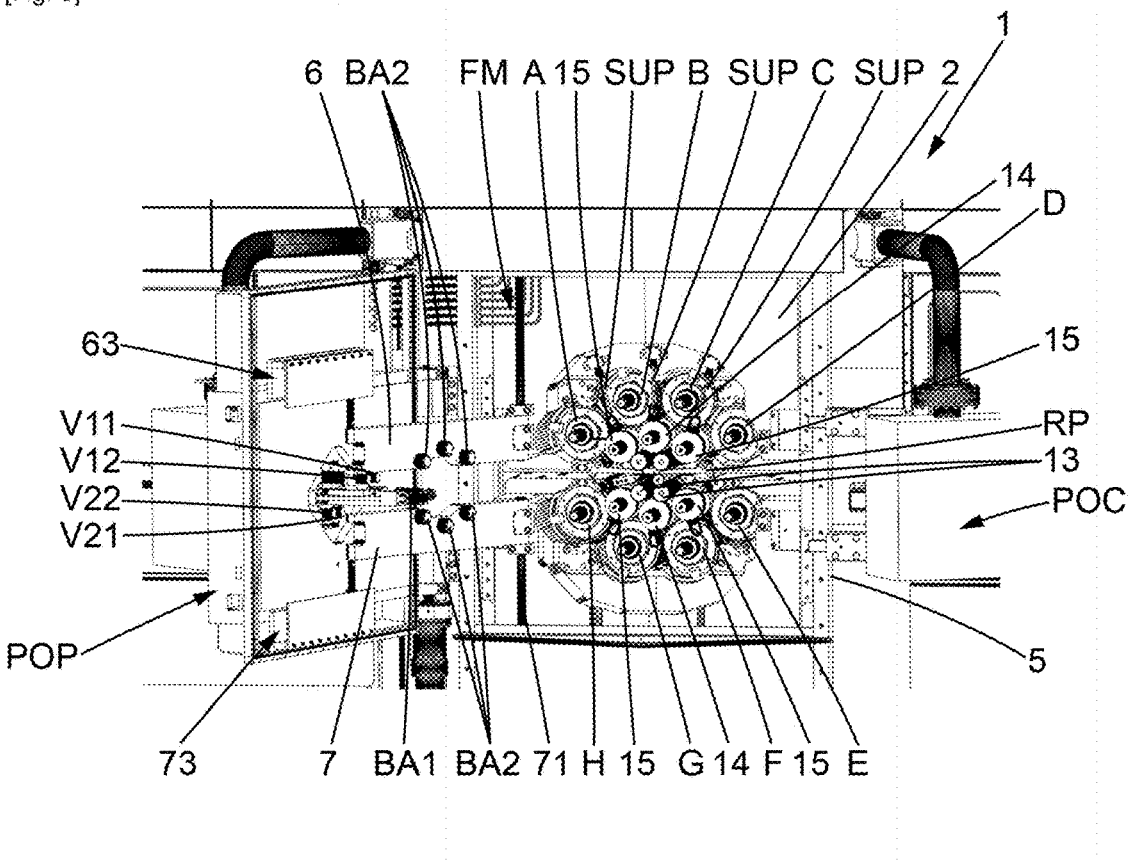
[Fig. 4]
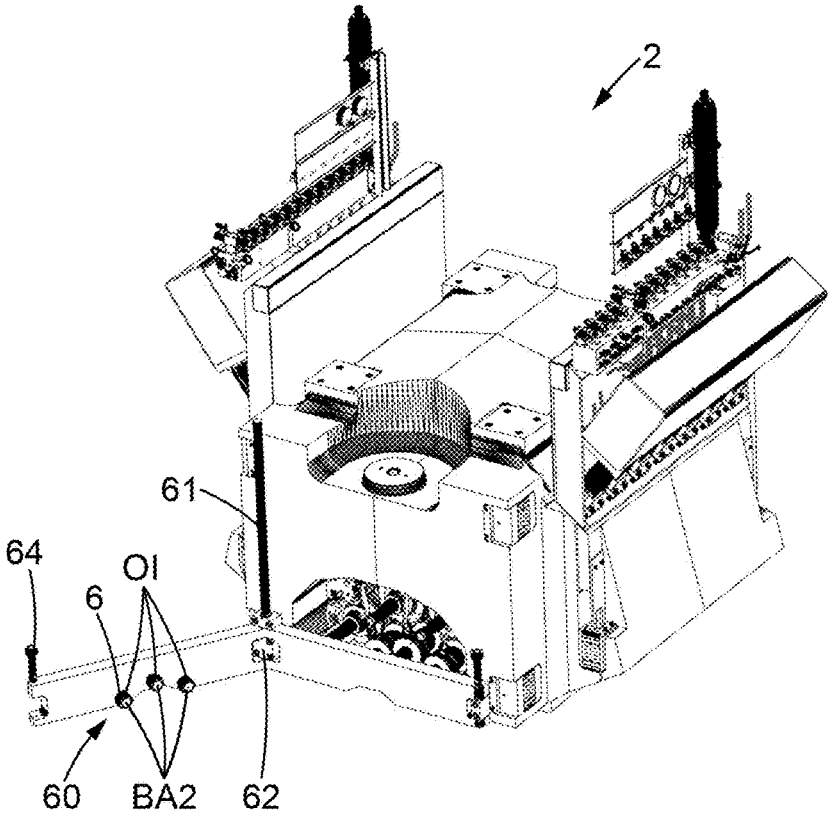

[Fig. 5]
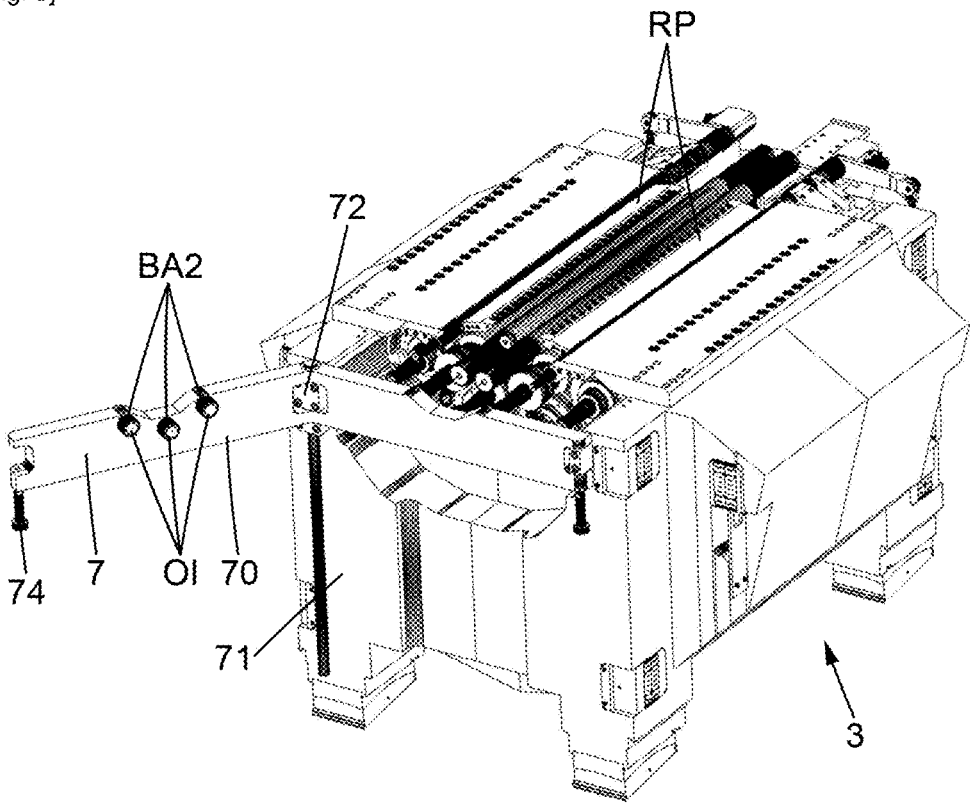

ROLLING MILL WITH MOVABLE HOUSING AND SEALED DOOR

FIELD

The present invention relates to the field of cold rolling, which allows the final thickness of a metal strip to be obtained through successively passing this strip between rolls in the presence of simultaneously high compressive and tensile forces.

BACKGROUND

A "Sendzimir"-type rolling mill includes a plurality of rolls, or barrels, which are arranged with respect to one another so as to enable a change in the mechanical characteristics of a metal strip and obtain a strip thickness that could be smaller than 3 millimetres.

The present invention relates more particularly to 20-high rolling mills of the type known to a person skilled in the art as a 'split housing' mill, and which substantially includes an upper housing part and a lower housing part, which are capable of moving relative to one another, and which contrasts the known prior art with a one-piece housing.

More particularly, a "Sendzimir" rolling mill is known and can include twenty rolls; an example embodiment of such a 20-high rolling mill is illustrated in the documents U.S. Pat. Nos. 5,193,377 and 5,471,859.

FIG. 1 accompanying the present description is derived from these two applications.

This FIG. 1 represents a diagrammatic view of a cross-section of a twenty-high rolling mill. In this figure, the rolls are distributed into a lower group $G_I$ and an upper group $G_S$; more specifically, these groups $G_I$ and $G_S$ have a symmetrical structure and each includes ten rolls including: one work roll 12, two first intermediate rolls 13, three second intermediate rolls 14 and 15, and four backup rolls, or backup roller assemblies, which are outside the arrangement and which are denoted A, B, C and D for the upper group $G_S$ and E, F, G, H for the lower group $G_I$.

This nomenclature for the different constituent rolls of a twenty-high rolling mill is common in the rolling mill field, and is well known to a person skilled in the art.

It is well-known in the rolling mill field that this roll arrangement illustrated in FIG. 1 allows a metal strip BM to be efficiently worked to obtain the desired strip thickness.

Documents U.S. Pat. Nos. 5,193,377, and 5,471,859 disclose such a rolling mill with a one-piece housing, which allows only a small gap between the upper and lower work rolls respectively, which can cause difficulties, in particular when maintenance operations, typically roll changes, are required.

In such a 20-high rolling mill with a one-piece housing, the maintenance access window is closed by a large door. During rolling operations, this door procures a seal impervious to lubricating/cooling oil, which is sprayed in the housing at a high rate by spray bars, internal to the housing. This door is articulated via hinges to a frame of the housing, to give access to all 20 rolls when in its open position, i.e. the two work rolls, the four first intermediate rolls, and the six second intermediate rolls, and the eight backup roller assemblies.

Such a prior art with a one-piece housing is, for example, disclosed in the document WO 2015/071608 A1 of the present Applicant.

WO2015/071608 A1 discloses that the (large) access door, referred to as the main door in WO 2015/071608 A1, can be equipped with a hatch, i.e. a small door, articulated to the main door. This small door simplifies the maintenance of the work rolls, and of the first intermediate rolls, by allowing access thereto, advantageously without the need to open the main door which remains closed.

In this way, and with the hatch in an open position, the latter allows access to the work rolls 12 and to the first intermediate rolls 13 through a central opening formed in the main door, advantageously, without having to open the main door, which is a much more tedious operation.

With the hatch in a closed position (the main door thus being closed), the hatch closes said opening in the main door, said hatch being equipped with stops ensuring the axial wedging of the work rolls 12 (at the front), during the rolling operations.

A 20-high rolling mill can typically comprise a device for displacing the first intermediate rolls, in particular of the push-pull type or even of the push-push type as per the disclosure of WO 2015/071608 A1. Such a push-push device thus comprises at least a first pair of cylinders at the front, and at least a second pair of cylinders at the bottom of the housing, each of the cylinders including a bearing portion configured to exert a thrust on the first intermediate rolls. Such a displacement device allows the size of the axial overlap between the first intermediate rolls to be controlled, and thus this size to be adapted to the width of the metal strip to be rolled.

The hatch can thus be equipped with the thrust cylinders belonging to the push-push type displacement device. The second intermediate rolls 14, 15, of which there are three for the upper group Gs and three for the lower group Gs, are conventionally articulated at their ends by bearing housings. Such bearing housings are connected to the housing by suspensions for the second, upper intermediate rolls. The main door is thus fitted with stops that rest against the bearing housings when the door is closed. The second intermediate rolls are typically driven in rotation by drive means, on the housing side opposite the maintenance window.

In a 20-high rolling mill with a one-piece housing, the rolling operations are carried out under an intense oil spray, from spray bars, typically two upper bars and two lower bars, inside the housing. Once the door (which is optionally equipped with a hatch) is closed, the door covers the entire maintenance window at the front of the housing in an oil-tight manner, protecting the external environment of the housing from oil projections.

However, in such a 20-high rolling mill with a one-piece housing, the two work rolls can only be moved apart (from one another) in the vertical direction by a small distance, and typically only by the stroke permitted by the eccentric rotations internal to the four upper backup roller assemblies A to D, and the eccentric rotations internal to the four lower backup roller assemblies, E to H. A small gap between the work rolls can be detrimental during maintenance operations, in particular roll change operations, due to the small clearance created for extracting or inserting the rolls, or, for example, in the event of strip breakage, for extracting any strip pieces trapped inside the housing.

The prior art for 20-high rolling mills further includes rolling mills known as 'split housing' mills, each of which significantly comprises two parts that are capable of moving vertically relative to one another, thus allowing for an increased opening between the work rolls compared to the prior art for rolling mills with a one-piece housing.

The two movable housing parts comprise an upper housing part, receiving the upper group rolls, and a lower housing part, receiving the lower group rolls, the upper housing part and the lower housing part being capable of moving relative to one another in the vertical direction, typically as the result of a hydraulic system. Such a rolling mill with two housing parts, one upper and one lower respectively, allows the work rolls to be moved apart when opening the housing, and over a greater distance than is possible with a rolling mill having a one-piece housing.

Document U.S. Pat. No. 3,858,424 is one example of such a 'split housing' type mill, which comprises:

- a fixed outer housing significantly inside this outer housing;
- an upper inner housing, and a lower inner housing, capable of moving relative to one another by the action of a hydraulic clamping cylinder base interposed between the lower inner housing and a base of the outer housing. A pass line adjusting device is interposed between the upper inner housing and an upper part of the outer housing.

In such a prior art, the maintenance window of the housing typically comprises a door system with several movable parts, and in particular three parts capable of moving relative to one another, and according to a first 'split housing' type rolling mill family.

The door system according to U.S. Pat. No. 3,858,424 thus comprises two doors that can be moved according to the displacements of the lower and upper inner housings, and a central fixed door, i.e. respectively:

- a first, central door, extending in height, at the work rolls, articulated via a hinge to one side of the fixed, outer housing, the central door being secured by a closure on the other side of the outer housing, this central door significantly carrying a roller with a vertical axis forming an axial stop at the front for the work rolls, and as shown in FIG. 2 of the document U.S. Pat. No. 3,858,424,
- a second door and a third door, capable of moving relative to one another and relative to the central door, the second door and the third door respectively arranged above and below the first central door, the second and third doors being integral with the upper and lower inner housings respectively.

The second door is hinged to the upper inner housing and includes an axial stop for a bearing of the second upper intermediate roll. The third door is hinged to the lower inner housing and includes an axial stop for a bearing of the second lower intermediate roll.

In such a prior art, the second door thus accompanies the vertical movements of the upper housing part, whereas the third door accompanies the vertical movements of the lower housing part, the first central door remaining unmoving.

The prior art of 'split housing' mills includes alternative embodiments with only two doors, one upper and one lower door respectively, and respectively integral with two housing parts that are capable of moving relative to one another, one of the two doors further carrying an axial stop for the work rolls.

Such a prior art for a multi-part door system, which parts are capable of moving relative to one another according to the movements of the lower and upper housings, is advantageous, compared to a fixed single-door solution, in that it advantageously enables the movable lower and upper doors to be equipped with two oil emulsion injection systems intended to lubricate the bearing housings of the second intermediate rolls, i.e. an upper injection system associated with the upper door, advantageously always accompanies the vertical movement of the bearing housings of the second upper intermediate rolls, to ensure the lubrication thereof by injection, from injection ports on this movable upper door, which are always centred with ports facing the bearing housings of the second upper rolls, and whereas a lower injection system, associated with the lower door, advantageously always accompanies the movement of the bearing housings of the second lower intermediate rolls, to ensure the lubrication thereof by injection, from injection ports on this lower door, which are always centred with ports facing the bearing housings of the second lower intermediate rolls.

However, such a prior art with several movable doors (two or three doors) requires the presence of operating clearances between the movable doors, but typically also above the upper door and below the lower door, and due to the relative displacement between the two movable doors, which are integral with the lower and upper housing parts respectively.

During rolling operations taking place under intense lubrication by the internal spray bars of the housing, large quantities of oil escape through a gap between doors, or even a gap above the upper door and a gap below the lower door, requiring the presence of an oil collection system, outside the housing, and often the presence of an additional closing system for the doors, typically in the form of a roller shutter (often called a "louvre") covering the front of the housing over the entire height thereof.

The prior art for 'split housing' mills, however, discloses, according to a second known family, use of a main door, integral with a fixed outer housing, closing off, following the example of the prior art for rolling mills with a one-piece housing, the entire maintenance window of the housing. In such a case, slide bearings are provided on an inner wall of the door, acting as axial stops for the bearing housings of the second intermediate rolls.

The slide bearings extend over a significant portion of the height of the fixed main door, such that the housing can slide on this bearing over a nominal operating stroke of the upper and lower housing parts, during vertical movements of the housing parts, which, for example, are greater than 100 mm. Given the amplitude of the vertical movements between the upper and lower housing doors and the fixed door, this sealed-door solution is not compatible with the injection systems for lubricating the bearing housings of the second intermediate rolls: such a stroke does not allow the injection ports of an injection system to be kept centred facing a port of the bearing housing.

Such a door system, with a large fixed door for a 'split housing' mill, although sealed, does not meet all requirements, and in particular those of 20-high rolling mills requiring intensive lubrication of the bearing housings of the second intermediate rolls.

SUMMARY

The present invention aims to improve the situation.

It proposes a 20-high rolling mill configured for rolling a metal strip, comprising:

- an upper group comprising:
  - one upper work roll,
  - two first upper intermediate rolls,
  - three second upper intermediate rolls,
  - four upper backup roller assemblies,
- a lower group comprising:
  - one lower work roll:
  - two first lower intermediate rolls,
  - three second lower intermediate rolls,
  - four lower backup roller assemblies, a housing system comprising two parts capable of moving relative to one another and respectively forming an upper housing part, configured to transmit a clamping force to the four backup roller assemblies, of the upper group, and a lower housing part, configured to transmit a clamping force to the four backup roller assemblies of the lower group, a hydraulic clamping mechanism configured to switch the housing system from a housing-open position, in which the upper housing part and the lower housing part are spaced apart from one another, into a clamping position, in which the upper housing part and the lower housing part are moved towards one another, and wherein the housing system includes a door configured to switch from an open position clearing a maintenance window of the housing system, at the front, providing access to the rolls and backup roller assemblies of the upper group and providing access to the rolls and backup roller assemblies of the lower group, and a closed position in which the door closes the maintenance window, a system of axial stops for the work rolls, the axial stops for the work rolls being configured to axially stop the work rolls, a system of axial stops for the second intermediate rolls, the axial stops for the second intermediate rolls being configured to axially stop said second lower and upper intermediate rolls, a device for displacing the first intermediate rolls, configured to axially displace the first lower and upper intermediate rolls relative to one another.

According to the present invention, said door cooperates, in said closed position, with a peripheral frame of a fixed frame structure of the housing system surrounding the maintenance window, said door closing, in a sealed manner, said maintenance window, said system of axial stops for the second intermediate rolls comprising:

an upper arm carrying axial stops for axially stopping the second upper intermediate rolls, at the front, said upper arm being mounted on the upper housing part so as to accompany the vertical movements of the upper housing part relative to the door; said upper arm being arranged between the door and the second upper intermediate rolls, when the door is in the closed position, and/or a lower arm carrying axial stops for axially stopping the second lower intermediate rolls, said lower arm being mounted on the lower housing part so as to accompany the vertical movements of the lower housing part relative to the door, said lower arm being arranged between the door and the second lower intermediate rolls, when the door is in the closed position.

The features outlined in the following paragraphs can optionally be implemented independently or in combination with one another.

According to one embodiment, the second intermediate rolls are articulated by their longitudinal ends to bearing housings and wherein the axial stops for stopping the second intermediate rolls cooperate with said bearing housings.

According to one embodiment:

the upper arm carries an upper lubricating fluid injection system, comprising a lubricating fluid pipe communicating with a plurality of injection ports on the axial stops facing bearing housing ports of the second upper intermediate rolls, at the front, the lower arm carries a lower lubricating fluid injection system, comprising a lubricating fluid pipe communicating with a plurality of injection ports on the axial stops facing bearing housing ports of the second lower intermediate rolls, at the front.

According to one embodiment, the upper arm is articulated via an upper hinge along a vertical pivot axis to the upper housing part and/or the lower arm is articulated via a lower hinge along a pivot axis to the lower housing part.

According to one embodiment, the upper injection system is supplied with lubricating fluid from a pipe that runs along the upper housing part and communicates with the pipe of the upper arm through the upper hinge and wherein the lower injection system is supplied with lubricating fluid from a pipe that runs from the lower housing part and communicates with the pipe of the lower arm through the lower hinge.

According to one embodiment, the door is articulated to the frame of the fixed frame structure by a hinge system, allowing the door to pivot, the hinge system of the door, on the one hand, and the upper hinge and/or the lower hinge, on the other hand, being arranged relative to a clamping plane of the housing, on the same side of the maintenance window, and wherein:

the door and the upper arm are provided with an upper guidance system including a cam and a cam follower, the cam being carried by the door, the cam follower being carried by the upper arm, at a distal end of the first arm, opposite a proximal end articulated to the upper hinge, said cam and cam follower system being configured to ensure that the upper arm opens when the door is opened from the closed position into the open position, or conversely to ensure that the upper arm closes when the door is closed from the open position into the closed position, and/or, the door and the lower arm are provided with a lower guidance system including a cam and a cam follower, the cam being carried by the door, the cam follower being carried by the lower arm, at a distal end of the first arm, opposite a proximal end articulated to the lower hinge, said cam and cam follower system being configured to ensure that the lower arm opens when the door is opened from the closed position into the open position, or conversely to ensure that the lower arm closes when the door is closed from the open position into the closed position.

For example:

the cam of the lower guidance system is a downwardly opening upper groove, and said cam follower is a roller configured to run in said groove, the cam of the lower guidance system is an upwardly opening lower groove, and said cam follower is a roller configured to run in said groove.

According to one embodiment, the door is a main door, provided with a central opening, closed by a hatch, configured to switch from an open position of the central opening, allowing access to the work rolls, and to the first intermediate rolls, into a closed position of the hatch closing off said central opening, and wherein the hatch carries the one or more axial stops, ensuring the work rolls at the front are axially stopped.

According to one embodiment, the displacement device comprises:

a first upper pair of hydraulic cylinders, at the front, configured to exert thrust on the ends of the first upper intermediate rolls, at the front, and a second upper pair of hydraulic cylinders, at the bottom of the housing, configured to exert forces on the ends of the first upper intermediate rolls, at the bottom of the housing and, a first lower pair of hydraulic cylinders, at the front, configured to exert thrust forces on the ends of the first lower intermediate rolls, at the front, and a second lower pair of hydraulic cylinders, at the bottom of the housing, configured to exert forces on the ends of the first lower intermediate rolls.

In particular, and according to one embodiment, said first upper pair of hydraulic cylinders, at the front, and the first upper pair of hydraulic cylinders, at the front, are embedded in the hatch.

BRIEF DESCRIPTION OF THE DRAWINGS

Other features, details and advantages will appear upon reading the detailed description hereinafter, and analysing the accompanying drawings, in which:

FIG. 1 is a diagrammatic view of the roll arrangement of a 20-high rolling mill according to the present invention.

FIG. 2 is a view of a rolling mill according to the present invention, with the (main) door, in the closed position against a peripheral, fixed frame, and in a peripherally sealed manner, whereas a hatch is open, clearing a central opening in the door allowing access to and extraction of the work rolls, or even of the first intermediate rolls, through said central opening.

FIG. 3 is a view of the 20-high rolling mill, with the door in the open position, providing access to all rolls and backup roller assemblies of the rolling mill, and with the housing system in an open position in which an upper housing part and a lower housing part are spaced apart from one another, opening a clearance between the upper group and the lower group of rolls, said door being hinged to a fixed frame structure, said door being configured to automatically drive:

an opening of an upper arm carrying axial stops for the second intermediate rolls of the upper group, by means of an upper cam/cam follower system, said cam being formed by an upper groove in the door, and the cam follower by a roller arranged at a distal end of the upper arm, opposite a proximal end of the arm articulated to said upper housing part via an upper hinge, an opening of a lower arm carrying axial stops for the second intermediate rolls of the lower group, by means of a lower cam/cam follower system, said cam being formed by a lower groove in the door, and the cam follower by a roller arranged at a distal end of the lower arm, opposite a proximal end of the arm articulated to said lower housing part via a lower hinge.

FIG. 4 is a close-up view of the upper housing part, configured such that it is capable of moving relative to the fixed frame structure and said lower housing part.

FIG. 5 is a close-up view of the lower housing part, configured such that it is capable of moving relative to the fixed frame structure and said upper housing part.

DETAILED DESCRIPTION

The present invention relates to a 20-high rolling mill 1 configured for rolling a metal strip BM.

A 20-high rolling mill comprises an upper group and a lower group of rolls/backup roller assemblies.

The upper group $G_S$ comprises:

one upper work roll 12, two first upper intermediate rolls 13, three second upper intermediate rolls 14, 15, four upper backup roller assemblies A, B, C, D.

The lower group $G_I$ comprises:

one lower work roll 12:

two first lower intermediate rolls 13, three second lower intermediate rolls 14, 15, four lower backup roller assemblies H, G, F, E.

Such a 20-high rolling mill configuration is known per se in the prior art.

The rolling mill comprises a housing system comprising two parts that are capable of moving relative to one another, respectively forming an upper housing part 2, configured to transmit a clamping force to the four backup roller assemblies A, B, C, D, of the upper group $G_S$, and an upper housing part 3 configured to transmit a clamping force to the four backup roller assemblies E, F, G, H of the lower group GI, as well as a hydraulic clamping mechanism configured to switch the housing system from a housing-open position POC in which the upper housing part 2 and the lower housing part 3 are spaced apart from one another, into a clamping position in which the upper housing part and the lower housing part are moved closer to one another, and which is suitable for the rolling operations of the metal strip Bm.

The rolling mill according to the present invention thus belongs to the family of rolling mills with two-part housings, known by a person skilled in the art as 'split housing' mills, as opposed to the family of rolling mills with a one-piece housing.

Each backup roller assembly A to E typically comprises, in a manner known per se, a support shaft along which rollers typically formed by bearings are distributed. For this purpose, the inner ring of each bearing is mounted on the support shaft, the outer ring of the bearing being intended to roll on one or even two adjacent rolls belonging to the rolls of the second intermediate rolls. The backup roller assembly further comprises a saddle, the arched body whereof extends longitudinally over the length of the support shaft, and one convex face whereof is intended to bear on a concave seat of a mounting portion of the housing, i.e. a mounting portion of the upper housing part 2 for the backup roller assemblies A to D, and a mounting portion of the lower housing part 3 for the backup roller assemblies E to H. This saddle also has extensions projecting from the concave face of the body, through which the support shaft passes, the extensions being distributed over the length of the shaft and being in particular disposed between the rollers. Eccentric rings are also provided between the support shaft and these extensions, the shaft having a pinion intended to mesh in the housing of the rolling mill with a corresponding pinion or a rack. This pinion (or this rack) thus allows the support shaft to be driven such that it rotates, and thus allows the position of the support shaft and of the rollers carried thereby to be moved away from or towards the arched body of the saddle, thanks to the eccentric rings.

The housing system includes a door 4 configured to switch from an open position POP into a closed position.

In the open position POP, the housing system clears a maintenance window FM of the housing system, at the front, providing access to the rolls 12, 13, 14, 15 and to the backup roller assemblies A, B, C, D of the upper group $G_S$ and providing access to the rolls 12, 13, 14, 15 and to the backup roller assemblies A, B, C, D of the lower group $G_I$. These components can be maintained by extracting the rolls or backup roller assemblies through the maintenance window FM, typically for replacement with new/reconditioned rolls/backup roller assemblies.

The rolling mill 1 typically comprises:

a system of axial stops for the work rolls, the axial stops BA1 for the work rolls being configured to ensure axial stopping of the work rolls 12 comprising at least a first stop, at the front, configured to ensure contact is made with the longitudinal ends of the work rolls, at the front, and at least a second stop, configured to ensure contact is made with the longitudinal ends of the work rolls, at the bottom of the housing, a system of axial stops for the second intermediate rolls 14, 15, the axial stops BA2 for the second intermediate rolls BA2 being configured to ensure axial stopping of said second lower and upper intermediate rolls 14, 15, comprising at least first stops, at the front, configured to ensure contact is made with the longitudinal ends of the second intermediate rolls, at the front, and at least second stops, configured to ensure contact is made with the longitudinal ends of the second intermediate rolls, at the bottom.

The rolling mill can typically comprise a device V11, V12, V21, V22 for displacing the first intermediate rolls 13, configured to ensure axial displacements of the first lower and upper intermediate rolls relative to one another. The displacement device can be of the pull-push type, or of the push-push type, thus comprising at least a first pair of cylinders at the front, and at least a second pair of cylinders at the bottom of the housing, each of the cylinders including a bearing portion configured to exert a thrust on the first intermediate rolls. A first pair of upper cylinders V11, V12 and a second pair of upper cylinders cooperate respectively with the distal ends of the two first intermediate rolls of the upper group $G_S$, whereas a first pair of lower cylinders V21, V22 and a second pair of lower cylinders cooperate respectively with the distal ends of the two first intermediate rolls of the lower group $G_I$.

Such a displacement device allows the size of the axial overlap between the first upper and lower intermediate rolls to be controlled, and thus this size to be adapted to the width of the metal strip to be rolled.

The 20-high rolling mill further comprises internal, arranged spray bars RP configured to spray the rolling strip and the rolls with a lubricating fluid, for example oil or oil emulsion, and typically:

two upper spray bars integral with the upper housing part 2, arranged on either side of the rolling plane passing through the axes of the work rolls 12, two lower spray bars integral with the lower housing part 3, arranged on either side of the rolling plane.

According to the present invention, said door 4 cooperates, in said closed position PFP, with a peripheral frame 5 of a fixed frame structure of the housing system surrounding the maintenance window FM. The door 4 is thus configured to sealingly close the front of the rolling mill. This avoids any risk of leakage at the front, compared to the prior art with a plurality of movable doors, as disclosed by U.S. Pat. No. 3,858,424.

According to the present invention, said system of axial stops BA2 for the second intermediate rolls 14,15 comprises, in particular:

an upper arm 6 carrying axial stops BA2 for axially stopping the second upper intermediate rolls 14, 15, at the front, said upper arm 6 being mounted on the upper housing part 2 so as to accompany the vertical movements of the upper housing part relative to the door 4; said upper arm 6 being arranged between the door 4 and the second upper intermediate rolls 14, 15, when the door is in the closed position PFP, and/or, a lower arm 7 carrying axial stops BA2 for axially stopping the second lower intermediate rolls 14, 15, said lower arm 7 being mounted on the lower housing part 3 so as to accompany the vertical movements of the lower housing part 7 relative to the door 4, said lower arm 7 being arranged between the door 4 and the second lower intermediate rolls 14, 15, when the door 4 is in the closed position PFP.

The rolling mill according to the present invention thus has the axial stop system BA2 of the second upper and lower intermediate rolls 14, 15, advantageously including axial stops that are capable of moving respectively with the upper and lower housing parts, given the reference numerals 2 and 3.

The axial stops BA2 carried by the upper arm 6 advantageously accompany the movements of the upper housing part 2, in particular during the rolling operations for the metal strip. These axial stops BA2 thus accompany the vertical movements of the second intermediate rolls 14, 15 of the upper group $G_S$ stressed by the upper housing part 2, while always remaining centred with said second upper intermediate rolls during the vertical movements. This can advantageously allow centring to be maintained between, on the one hand, injection ports of a lubricating fluid injection system, and on the other hand bearing housing inlet ports of the second upper intermediate rolls 14, 15.

The axial stops BA2 carried by the lower arm 7 advantageously accompany the movements of the lower housing part 3, in particular during the rolling operations for the metal strip. These axial stops BA2 accompany the vertical movements of the second intermediate rolls 14, 15 of the lower group $G_S$ stressed by the lower housing part 3, while always remaining centred with said second lower intermediate rolls during the vertical movements. This can advantageously allow centring to be maintained between, on the one hand, injection ports of a lubricating fluid injection system, and on the other hand bearing housing inlet ports of the second lower intermediate rolls 14, 15.

The rolling mill according to the present invention is advantageous in that it ensures a fluid-tight seal at the front through the door, hinged to the fixed frame structure, while allowing the axial stops BA2 of the second upper intermediate rolls 14, 15 to accompany the movements of the upper housing part 2 and allowing the axial stops BA2 of the second lower intermediate rolls 14, 15 to accompany the movements of the lower housing part.

In general, the second intermediate rolls 14, 15 can be articulated via the longitudinal ends thereof to bearing housings. The axial stops BA2 for stopping the second intermediate rolls thus cooperate with said bearing housings.

With regard to the second intermediate rolls 14, 15 of the upper group $G_S$, the bearing housings can be connected to the upper housing part 2 by means of suspensions SUP, which allow the second upper rolls 14, 15 to be suspended, when the two movable housing parts are spaced apart in said housing-open position POC, and as shown in FIG. 3.

In the case of the first rolls 13 of the upper group $G_S$, they can be kept at a distance from the metal strip BM by supports of the two spray bars RP fixed to the upper housing part 2, at least in particular orientations of the spray bars RP.

In a noteworthy manner, at least according to one embodiment, the rolling mill according to the present invention can provide for improved lubrication of the bearing housings by lubricating fluid injection systems 60, 70.

To this end:

the upper arm 6 can carry an upper lubricating fluid injection system 60, comprising a lubricating fluid pipe communicating with a plurality of injection ports OI on the axial stops BA2 facing bearing housing ports of the second upper intermediate rolls 14, 15, and/or the lower arm 7 can carry a lower lubricating fluid injection system 70, comprising a lubricating fluid pipe communicating with a plurality of injection ports OI on the axial stops BA2 facing bearing housing ports of the second lower intermediate rolls 14, 15.

The lubricating fluid from the pipes escapes from the injection ports of the axial bearings BA2 to flow into the ports of the bearing housings, in order to then provide lubrication to the bearings inside the housings, before escaping through a downstream opening in the housing.

According to one embodiment, the upper arm 6 can be articulated via an upper hinge 62 along a vertical pivot axis to the upper housing part 2 and/or the lower arm 7 can be articulated via a lower hinge 72 along a pivot axis to the lower housing part 3. The pivot axis of the upper hinge 62 and the pivot axis of the lower hinge 72 can be coaxial.

The upper hinge 62 is configured to allow for the switching of the upper arm 6 from a closed position in which the axial stops BA2 carried by the arm 6 stop the second intermediate rolls 14, 15 of the upper group $G_S$, at the front on the maintenance window side, into an open position in which the axial stops BA2 are retracted to allow the second upper intermediate rolls 14, 15 to be removed.

The lower hinge 72 is configured to switch the lower arm 7 from a closed position in which the axial stops BA2 carried by the arm 7 stop the second intermediate rolls 14, 15 of the lower group $G_I$, at the front on the maintenance window side, into an open position in which the axial stops BA2 are retracted to allow the second lower intermediate rolls 14, 15 to be removed.

It should be noted that:

the upper injection system 60 can be supplied with lubricating fluid from a pipe 61 which runs along the upper housing part 2, which is integral with the latter, and communicates with the pipe of the upper arm 6 through the upper hinge 62, the lower injection system 70 is supplied with lubricating fluid from a pipe 71 which runs from the lower housing part 3, which is integral with the latter, and communicates with a pipe of the lower arm 7 through the lower hinge 72.

In general, the door 4 can be articulated to the frame 5 of the fixed frame structure by a hinge system 40, allowing the door to pivot. The hinge system of the door, on the one hand, and the upper hinge 61 and/or the lower hinge 72, on the other hand, are arranged relative to a clamping plane of the housing, on the same side of the maintenance window FM. The pivot axis of the door 4 and the axes of the arms 6 and 7 are preferably parallel.

According to one embodiment, the rolling mill can comprise a mechanism that automatically opens and closes the upper and/or lower arms, depending on the opening and closing movement of the door 4.

For this purpose, the door 4 and the upper arm 6 can be provided with an upper guidance system including a cam 63 and a cam follower 64, the cam 63 being carried by the door 4, the cam follower 64 being carried by the upper arm 6, in particular at a distal end of the first arm 6, opposite a proximal end articulated to the upper hinge 62.

The cam 63 and cam follower 64 system is advantageously configured to open the upper arm 6 when the door 4 is opened from the closed position PFP into the open position POP, or conversely to close the upper arm 6 when the door 4 is closed from the open position POP into the closed position PFP.

It should be noted that the cam 63 of the lower guidance system can be a downwardly opening upper guide groove, and said cam follower 64 is an upwardly projecting roller configured to run in said groove, along the latter in a horizontal direction. The depth of the groove in the vertical direction can advantageously be greater than the height of the roller in the vertical direction, so as to allow vertical movements of the roller, integral with the upper housing part 2, inside the groove integral with the fixed door.

The door 4 and the lower arm 7 can be provided with a lower guidance system including a cam 73 and a cam follower 4, the cam 73 being carried by the door 4 and the cam follower 74 being carried by the lower arm 7, in particular at a distal end of the first arm 6, opposite a proximal end articulated to the lower hinge 72.

Said cam 73 and cam follower 74 system is configured to open the lower arm 7 when the door 4 is opened from the closed position PFP into the open position POP, or conversely to close the lower arm 7 when the door 4 is closed from the open position POP into the closed position. The cam 73 of the lower guidance system can be an upwardly opening lower groove, extending lengthwise in a horizontal direction, and said cam follower 74 is a downwardly projecting roller configured to run in said groove.

The depth of the groove in the vertical direction can advantageously be greater than the height of the roller in the vertical direction, so as to allow the vertical movements of the roller, integral with the lower housing part 3, inside the groove integral with the fixed door.

According to one embodiment, the door 4 can be a main door, provided with a central opening, closed by a hatch 8, configured to switch from an open position of the central opening, allowing access to the work rolls, and to the first intermediate rolls 13, into a closed position of the hatch closing off said central opening. The hatch carries the one or more axial stops BA1, ensuring the axial stopping of the work rolls 12, at the front.

According to one embodiment, the displacement device comprises:

the first upper pair of hydraulic cylinders V11, V12, at the front, configured to exert thrust on the ends of the first upper intermediate rolls 13, at the front, and the second upper pair of hydraulic cylinders, at the bottom of the housing, configured to exert forces on the ends of the first upper intermediate rolls 13, at the bottom of the housing and, the first lower pair of hydraulic cylinders V21, V22, at the front, configured to exert thrust on the ends of the first lower intermediate rolls 13, at the front, and the second lower pair of hydraulic cylinders, at the bottom of the housing, configured to exert forces on the ends of the first lower intermediate rolls 13.

According to one embodiment, said first upper pair of hydraulic cylinders V11, V12, at the front, and the first upper pair of hydraulic cylinders V21, V22, at the front, are embedded in the hatch 8.

LIST OF THE REFERENCES

1. 20-high rolling mill,
2. Upper housing part,
3. Lower housing part,
POC. Open position of the housing
4. Door,
PFP, POP. Respectively the closed position and open portion of the door,
FM. Front maintenance window
5. Peripheral frame (fixed frame structure),

6. Upper arm (carrying axial stops for the second upper intermediate rolls),
7. Lower arm (carrying axial stops for the second lower intermediate rolls),
60. Upper injection system (lubricating fluid),
61. Fluid pipe (mounted on the upper housing part),
62. Upper hinge,
63, 64. Cam and cam follower (upper guidance system),
73, 74. Cam and cam follower (lower guidance system),
70. Lower injection system (lubricating fluid),
71. Fluid pipe (mounted on the lower housing part),
72. Lower hinge,
$G_S$. Upper group,
$G_I$. Lower group,
12. Work rolls,
13. First intermediate rolls,
14, 15. Second intermediate rolls,
A, B, C, D, E, F, G, H. Backup roller assembly,
BA1. Axial stops (work roll 12),
BA2. Axial stops (second intermediate rolls),
OI. Injection ports (cooling fluid for the axial stops)
V11, V12, V21, V22. Thrust cylinders, at the front, for displacing the first, respectively upper and lower, intermediate rolls.

The invention claimed is:

1. A 20-high rolling mill configured for rolling a metal strip, comprising:

an upper group comprising:
one upper work roll,
two first upper intermediate rolls,
three second upper intermediate rolls,
four upper backup roller assemblies, a lower group comprising:
one lower work roll:
two first lower intermediate rolls,
three second lower intermediate rolls,
four lower backup roller assemblies, a housing system comprising two parts moving relative to one another, respectively forming an upper housing part, configured to transmit a clamping force to the four upper backup roller assemblies, of the upper group, and a lower housing part, configured to transmit a clamping force to the four lower backup roller assemblies of the lower group, a hydraulic clamping mechanism comprising a hydraulic cylinder configured to switch the housing system from a housing-open position, in which the upper housing part and the lower housing part are spaced apart from one another, into a clamping position, in which the upper housing part and the lower housing part are moved towards one another, and wherein the housing system includes a door configured to switch from an open position clearing a maintenance window of the housing system, at a front, providing access to the upper work roll, the first upper intermediate rolls, the second upper intermediate rolls and the upper backup roller assemblies of the upper group and providing access to the lower work roll, the first lower intermediate rolls, the second lower intermediate rolls and the lower backup roller assemblies of the lower group, and a closed position in which the door closes the maintenance window, a system of axial stops for the work rolls, the axial stops for the work rolls being configured to axially stop the work rolls, a system of axial stops for the second intermediate rolls, the axial stops for the second intermediate rolls being configured to axially stop said second lower and upper intermediate rolls, a device for displacing the first intermediate rolls, comprising hydraulic cylinders configured to ensure axial displacements of the first lower and upper intermediate rolls relative to one another, and wherein said door-cooperates, in said closed position, with a peripheral frame of a fixed frame structure of the housing system surrounding the maintenance window, said door closing, in a sealed manner, said maintenance window, said system of axial stops for the second intermediate rolls comprising:

an upper arm carrying the axial stops for axially stopping the second upper intermediate rolls, at a front, said upper arm being mounted on the upper housing part so as to accompany vertical movements of the upper housing part relative to the door; said upper arm being arranged between the door and the second upper intermediate rolls, when the door is in the closed position, and a lower arm carrying the axial stops for axially stopping the second lower intermediate rolls, said lower arm being mounted on the lower housing part so as to accompany vertical movements of the lower housing part relative to the door, said lower arm being arranged between the door and the second lower intermediate rolls, when the door is in the closed position.

2. The 20-high rolling mill according to claim 1, wherein the second intermediate rolls are articulated by their longitudinal ends to bearing housings and wherein the axial stops for stopping the second intermediate rolls cooperate with said bearing housings.

3. The 20-high rolling mill according to claim 2, wherein:

the upper arm carries an upper lubricating fluid injection system, comprising a lubricating fluid pipe communicating with a plurality of injection ports on the axial stops facing bearing housing ports of the second upper intermediate rolls, at a front, the lower arm carries a lower lubricating fluid injection system, comprising a lubricating fluid pipe communicating with a plurality of injection ports on the axial stops facing bearing housing ports of the second lower intermediate rolls, at a front.

4. The 20-high rolling mill according to claim 1, wherein the upper arm is articulated via an upper hinge along a vertical pivot axis to the upper housing part and the lower arm is articulated via a lower hinge along a pivot axis to the lower housing part.

5. The 20-high rolling mill according to claim 3, wherein the upper arm is articulated via an upper hinge along a vertical pivot axis to the upper housing part and the lower arm is articulated via a lower hinge along a pivot axis to the lower housing part, and wherein:

the upper injection system is supplied with lubricating fluid from a pipe that runs along the upper housing part and communicates with the pipe of the upper arm through the upper hinge and wherein:

the lower injection system is supplied with lubricating fluid from a pipe that runs from the lower housing part and communicates with the pipe of the lower arm through the lower hinge.

6. The 20-high rolling mill according to claim 4, wherein the door is articulated to the frame of the fixed frame structure by a hinge system, allowing the door to pivot, the hinge system of the door and the upper hinge and/or the lower hinge, being arranged relative to a clamping plane of the housing, on the same side of the maintenance window, and wherein:

the door and the upper arm are provided with an upper guidance system including a cam and a cam follower, the cam being carried by the door, the cam follower being carried by the upper arm, at a distal end of the first arm, opposite a proximal end articulated to the upper hinge, said cam and cam follower system being configured to ensure that the upper arm opens when the door is opened from the closed position into the open position, or conversely to ensure that the upper arm closes when the door is closed from the open position into the closed position, and, the door and the lower arm are provided with a lower guidance system including a cam and a cam follower, the cam being carried by the door, the cam follower being carried by the lower arm, at a distal end of the first arm, opposite a proximal end articulated to the lower hinge, said cam and cam follower system being configured to ensure that the lower arm opens when the door is opened from the closed position into the open position, or conversely to ensure that the lower arm closes when the door is closed from the open position into the closed position.

7. The 20-high rolling mill according to claim 5, wherein the door is articulated to the frame of the fixed frame structure by a hinge system, allowing the door to pivot, the hinge system of the door, on the one hand, and the upper hinge and/or the lower hinge, on the other hand, being arranged relative to a clamping plane of the housing, on the same side of the maintenance window, and wherein:

the door and the upper arm are provided with an upper guidance system including a cam and a cam follower, the cam being carried by the door, the cam follower being carried by the upper arm, at a distal end of the first arm, opposite a proximal end articulated to the upper hinge, said cam and cam follower system being configured to ensure that the upper arm opens when the door is opened from the closed position into the open position, or conversely to ensure that the upper arm closes when the door is closed from the open position into the closed position, and, the door and the lower arm are provided with a lower guidance system including a cam and a cam follower, the cam being carried by the door, the cam follower being carried by the lower arm, at a distal end of the first arm, opposite a proximal end articulated to the lower hinge, said cam and cam follower system being configured to ensure that the lower arm opens when the door is opened from the closed position into the open position, or conversely to ensure that the lower arm closes when the door is closed from the open position into the closed position.

8. The 20-high rolling mill according to claim 6, wherein:

the cam of the lower guidance system is a downwardly opening upper groove, and said cam follower is a roller configured to run in said groove, the cam of the lower guidance system is an upwardly opening lower groove, and said cam follower is a roller configured to run in said groove.

9. The 20-high rolling mill according to claim 1, wherein the door is a main door, provided with a central opening, closed by a hatch, configured to switch from an open position of the central opening, allowing access to the work rolls, and to the first intermediate rolls, into a closed position of the hatch closing off said central opening, and wherein the hatch carries the one or more axial stops, ensuring the work rolls at the front are axially stopped.

10. The 20-high rolling mill according to claim 1, wherein the displacement device comprises:

a first upper pair of hydraulic cylinders, at a front, configured to exert thrust on the ends of the first upper intermediate rolls, at the front, and a second upper pair of hydraulic cylinders, at the bottom of the housing, configured to exert forces on the ends of the first upper intermediate rolls, at the bottom of the housing and, a first lower pair of hydraulic cylinders, at a front, configured to exert thrust forces on the ends of the first lower intermediate rolls, at the front, and a second lower pair of hydraulic cylinders, at the bottom of the housing, configured to exert forces on the ends of the first lower intermediate rolls.

11. The 20-high rolling mill according to claim 9, wherein:

the displacement device comprises:

a first upper pair of hydraulic cylinders, at a front, configured to exert thrust on the ends of the first upper intermediate rolls, at a front, and a second upper pair of hydraulic cylinders, at a bottom of the housing, configured to exert forces on the ends of the first upper intermediate rolls, at the bottom of the housing and, a first lower pair of hydraulic cylinders, at a front, configured to exert thrust forces on the ends of the first lower intermediate rolls, at the front, and a second lower pair of hydraulic cylinders, at a bottom of the housing, configured to exert forces on the ends of the first lower intermediate rolls and wherein said first upper pair of hydraulic cylinders, at the front, and the first upper pair of hydraulic cylinders, at the front, are embedded in the hatch.

* * * * *